United States Patent [19]

Jensfelt et al.

[11] 4,396,426

[45] Aug. 2, 1983

[54] MANUFACTURE OF LEAD FROM SULPHIDIC LEAD RAW MATERIAL

[75] Inventors: Torsten E. Jensfelt, Stocksund; Stig A. Petersson, Skelleftehamn, both of Sweden

[73] Assignee: Boliden Aktiebolag, Stockholm, Sweden

[21] Appl. No.: 322,686

[22] Filed: Nov. 18, 1981

[30] Foreign Application Priority Data

Dec. 1, 1980 [SE] Sweden ..... 8008425

[51] Int. Cl.[3] ..... C22B 13/00

[52] U.S. Cl. ..... 75/77; 75/21; 75/23

[58] Field of Search ..... 75/21, 23, 77

[56] References Cited

U.S. PATENT DOCUMENTS

| | | | |
|---|---|---|---|
| 3,326,671 | 6/1967 | Worner | 75/40 |
| 3,462,264 | 8/1969 | Richards | 75/78 |
| 3,563,726 | 2/1971 | Elvander | 75/10 R |
| 3,663,207 | 5/1972 | Themelis | 75/77 |
| 3,687,656 | 8/1972 | Maelzer | 75/74 |
| 3,847,595 | 11/1974 | Liang | 75/77 |
| 3,941,587 | 3/1976 | Queneau | 75/77 |
| 4,080,197 | 3/1978 | Meissner | 75/77 |
| 4,087,274 | 5/1978 | Edenwald | 75/10 R |

*Primary Examiner*—P. D. Rosenberg

*Attorney, Agent, or Firm*—Stevens, Davis, Miller & Mosher

[57] ABSTRACT

Lead is recovered from sulphidic lead raw-material containing impurities of the kind bismuth, arsenic, antimony and tin, by flame-smelting the material with an oxygen-containing gas. The oxygen potential and temperature are adapted during the flame-smelting process so that the product formed thereby comprises substantially a lead-sulphide melt substantially free of volatile, sulphidic and metallic impurities of the said kind. The lead-sulphide melt is brought into contact with an oxidic lead material substantially free of impurities of the aforementioned kind, while oxidizing the sulphide-sulphur content of the material and forming a melt substantially free of sulphur. Lead is recovered from the melt by separation, optionally after subjecting the melt or a part thereof to a reducing process.

7 Claims, 2 Drawing Figures

MANUFACTURE OF LEAD FROM SULPHIDIC LEAD RAW MATERIAL

Figure 1:
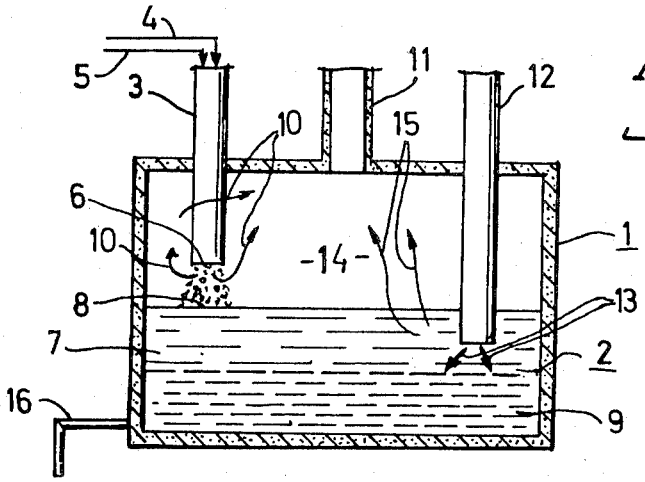

The invention relates to a method for manufacturing lead from sulphidic lead raw-material containing impurities of bismuth, arsenic, antimony and tin, by flame-smelting the material with an oxygen-containing gas.

For more than 50 years the major part of the world's production of lead by smelting processes has been achieved by melting lead in a shaft-furnace, in combination with sintering. It has been estimated that during the 1970's just over 80% of the world's lead production has been achieved in lead-smelting shaft-furnaces. Despite the many technological improvements achieved over the years, the melting of lead in shaft-furnaces has many serious disdvantages. The two-stage method combining shaft-furnace smelting and sintering is, in itself, thermally unfavourable. Thus, in the sintering stage the roasting reactions are highly exothermic and the concentrate and other material charged to the furnace must be mixed with cold re-cycled sintered material, in order to restrict the sintering temperature and to obtain a sinter having a low sulphur content. On the other hand, heat is required in the shaft furnace in order to melt the gangue, and expensive metallurgical coke is required, both as fuel and as a reductant.

In later years, several new lead-producing processes for so-called direct smelting have been proposed and tested, in which the lead concentrate is melted down by combusting the concentrate with oxygen-containing gas, to directly form metallic lead and sulphur dioxide together with slag in one single step in accordance with the partial reaction;

$$Pbs + O_2 \rightarrow Pb + SO_2$$

The direct smelting of lead offers many potential advantages compared with the smelting of lead in shaft-furnaces, these advantages being;

(a) that the sintering process, involving large quantities of circulating return-sinter is eliminated, (b) no coke is required, (c) less fuel is required, because the exothermic heat from the oxidation reactions is utilized to melt the lead concentrate, (d) oxygen-gas or oxygen enriched air can be used instead of atmospheric air, and (e) it is possible to produce a gas containing far more $SO_2$ than is possible when sintering.

The direct lead-smelting methods can principly be divided into two groups, namely those methods which provide a slag having a low lead content, which can be dumped, although at the cost of a crude lead which has a high sulphur content and which often requires separate treatment, for example, a converting process; and those which provide a crude lead having a low sulphur content and a slag having a high lead content, which must be refined in a separate stage. The following processes belong to this last mentioned group; Outokumpu-process (see for example DE,C, 1179004), Cominco-process (US,A, 3847595), St. Joseph Lead-process, J. Metals, 20 (12), 26–30 (1968), Worcra-process (US,A, 3326671), Kivcet-process (US,A, 3555164) and Q-S-process (US,A, 3941587). The following processes belong to the first mentioned group; the Boliden process (US,A, 3563726), Noranda-process (US,A, 3542352 and 3663207) and the Mitsubishi-process (US,A, 3890139).

Normally, lead-sulphite concentrate contains significant quantities of such elements as Cu, As, Sb, Sn, Bi, Ag and Au, which are desirably removed from the lead during the lead-producing process, for one reason or another. The major part of these elements will be present in the melt, i.e. in the crude lead and the slag, when lead is produced in accordance with the aforementioned methods. The distribution of these elements between crude lead and slag may, in certain instances, be influenced by the oxidation potential of the system; for example the amount of lead, copper, tin, arsenic and antimony dissolved in the slag increases with an increasing oxidation potential, while the distribution of bismuth and silver between crude lead and slag cannot be influenced by the partial pressure of oxygen, and hence a major part of these elements will still be found in the crude lead, from which they must be separated by means of separate refining methods which, at least in the case of bismuth, involve very high chemical costs and expensive and complicated treatment methods. In the case of silver, the treatment costs may be considered worthwhile, because of the value of the silver, even though said treatment is troublesome. Although, as before mentioned, the distribution of arsenic and antimony between crude lead and slag can be influenced by the partial pressure of oxygen, so much of these elements are found in the crude lead when practising known lead-producing processes that it is necessary to subject the crude lead to a subsequent refining process in one or more stages.

Thus, although new lead-producing processes have been proposed in recent years, there is a great and progressively more accentuated need of a new lead-producing process for working-up primarily lead-sulphide concentrates, which are relatively poor in lead but may still contain essential, other metal values, such as noble metals and zinc. In this lead-producing process it shall be possible to treat sulphidic raw materials containing elements of the above-indicated type while recovering a crude lead having low content of the aforementioned impurities. There is particular need for a method in which sulphidic lead material rich in bismuth can be worked up in one single stage, into a crude lead which is practically free from all bismuth.

An object of the present invention is to provide a method for working up sulphidic lead material containing impurities of the kind mentioned in the introduction, while recovering lead which is practically free from said impurities. The characterizing features of the invention are set forth in the following claims.

The method according to the invention can be carried out in a plurality of ways within the scope of the main claim, whereat the preferred method is chosen with respect to furnace types available and the material to be worked-up. Thus, the method can be carried out to advantage with very simple apparatus in a conventional reverberatory furnace or rotary converter with an oxidic lead melt, against which there is directed a lance, through which material containing lead-sulphide is charged and flame smelted with a limited supply of oxygen. In this way impurities which are volatile in sulphide form can be volatilized to a substantial degree in conjunction with the smelting process. Thus, when practising the method according to the invention substantial quantities of impurities of the type bismuth, arsenic and antimony can be removed. In conventional lead-producing processes, including the direct-smelting processes, in which lead-sulphide material is sintered or smelted at a high partial pressure of oxygen, this kind of impurity will quickly be oxidised to its highest oxidation state and, in practice, therewith become non-volatile. Consequently, a high percentage of the oxides formed will accompany the melt and be divided between the slag and the crude lead, as discussed in the introduction.

The present invention, however, affords the advantage whereby said impurities are caused to volatilize and transfer to the gas phase in a sulphidic or metallic form, before being subjected to an oxygen potential of such magnitude that the stable, non-volatile oxides are able to form these elements. When coming into contact with lead oxides or an oxidic lead bath—which possibly contains silicate—the following known reaction $$Pbs + 2PbO \rightarrow 3Pb + SO_2$$

will take place, the molten lead sulphide reacting with lead oxide in the bath beneath the lance to form lead and sulphur dioxide.

In this case, the oxidic melt is produced and maintained, suitably by flame smelting in a further lance a lead-sulphide material, which is substantially free from said impurities, with an excess of oxygen. This last mentioned lance should suitably be immersed to some extent in the lead oxide-containing melt. The lead formed by the roast reaction will form a layer beneath the lead-oxide bath, and can be tapped off, either intermittently or continuously. The lead will have a low sulphur content and will contain only minor quantities of such impurities as bismuth, arsenic, antimony, tin, cadmium, mercury and zinc. The refinement of such lead is far less complicated than the refinement of lead grades which can be produced when applying known direct smelting methods.

The method according to the invention can also be carried out in a furnace provided with two separate flame-smelting shafts, whereat similar reactions can be effected and, in principle, the same procedural steps can be taken as in the case when flame-smelting the lead-containing material by means of lances.

In a particularly preferred method of carrying out the invention there is used a type of furnace which has previously been described with reference to the reduction of metal-oxide containing materials, particularly materials containing iron oxide, for recovering crude iron therefrom, but which has also been proposed for the manufacture of lead from lead sulphide. The furnace is described in more detail in our earlier Patent Specification SE,B, 7700440-6, in which the furnace illustrated in FIG. 1 is provided with a shaft divided into two zones, whereat according to the description of the earlier Patent Specification sulphide-containing lead material is charged to the upper zone in the shaft and there roasted to form an oxidic product, which is melted together with separately charged oxidic material in the lower zone of the shaft, with the aid of hot gases arriving from beneath. The oxidic melt from the shaft is then reduced with the aid of a coke bed, in a reactor connected to the lower parts of the shaft. In distinction to this method, material containing lead sulphide in accordance with the method of the invention is flame-smelted in both zones of the shaft, whereat contaminated concentrates are charged to the shaft with an insufficiently of oxygen-containing gas in the upper zone, while a pure sulphide concentrate is charged to the shaft with an excess of oxygen-containing gas in the lower zone of said shaft. As with the method according to the above-mentioned earlier patent, flame smelting is suitably effected in this case with the aid of unsupported vortices in each of the zones of the shaft. The vortices are maintained by supplying the oxidising gas to the shaft through nozzles so directed as to give rise to a vortex-like movement around a substantially vertical axis. In this way, flame smelting can be carried out as a counter-flow method, in which volatile sulphides of impurities in the upper zone of the shaft can be removed directly from the shaft with the outgoing gas. Depending, among other things, on the relative quantities of material smelted in the upper and lower zones respectively, and on the degree of oxidation in the upper zone, the end product will contain varying quantities of metallic lead and lead oxide. The method can be controlled as desired, so that solely lead oxide is obtained, or substantially only metallic lead. The subsequent treatment to which the product is subjected is selected independence upon the composition of the molten product and the kind of product entailed. If a relatively pure crude-lead product is obtained, this can be removed directly by continuously tapping the product from an underlying separation zone connected to the shaft. This applies irrespective of which embodiment of the invention is used to flame-smelt the material to a crude-lead product.

When the flame-smelting process results in the total or partial formation of an oxidic lead product, said product can be finally reduced to metallic lead in a number of ways. One preferred method in this respect is to transfer the lead-oxide melt to another furnace in which reduction can be carried out while vigorously agitating the melt, for example in a Kaldo converter. One such method is described in our earlier Swedish Patent Specifications SE,B, 7317217-3 and 7317218-1. When the flame-smelting process is carried out in a vortex, as previously described, the oxidic melt can, to advantage, also be treated in the manner described in SE,B, 7700440-6, i.e. by bringing the lead-oxide melt into contact with a coke bed, whereat the coke reacts with molten lead-oxide to form metallic lead and carbon monoxide.

When the input raw material of the process contains large quantities of such metals as those which will accompany the lead and therewith be present in the resultant melt, acid slag formers, such as silica, can advantageously be charged simultaneously with the molten material, the method being carried out in a manner such that during the flame-smelting process there is formed a metal-oxide-silicate melt, from which metal can be recovered selectively in a subsequent stage by reduction. Strong reductants, generally coal or coke, are required for recovering the metals present in the metal-oxide-silicate melt, and it is preferred to increase the reactivity and selectivity, optionally by also charging a supplementary slag former, generally comprising CaO. This recovery of metal from the metal-oxide-silicate melt can be carried out continuously or intermittently in one or more process stages. Thus, a copper melt containing a precious or noble metal can be recovered in a first reduction stage, and the major part of the lead content recovered in a following stage. Metal can also be recovered selectively from the metal-oxide-silicate slag by injecting carbon and slag former directly into the metal-oxide-silicate melt. During the reduction process, the composition of the silicate melt can, to a certain extent, influence the distribution of metals between the metal melt and slag. If the basicity of the silicate melt is raised by adding CaO, it is possible to obtain lower sulphur content in the metal melt. If the metal-oxide-silicate melt contains a high percentage of lead, for example 15–45%, and a high $CaO/SiO_2$-ratio, it is possible to effectively recover copper, nickel, lead and/or noble metals, to obtain a metal melt having a low sulphur content, namely 0.1–0.5%.

Figure 2:
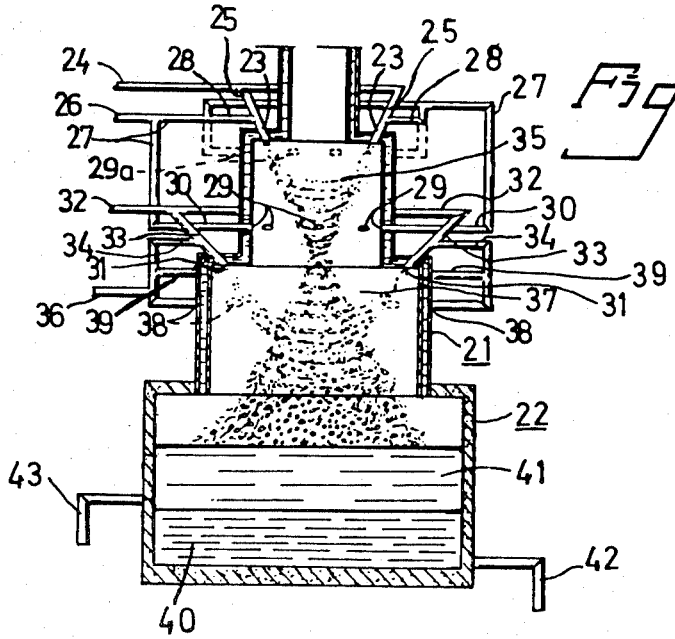

A number of preferred embodiments of the invention will now be described with reference to the accompanying drawing, in which FIG. 1 illustrates a preferred embodiment of the invention, in which the flame-smelting process is carried out with the aid of lances directed onto an oxidic bath, with one lance immersed in said bath, and FIG. 2 illustrates another preferred embodiment of the invention, in which the flame-smelting process is carried out in two zones in a shaft, one zone being located above the other, and in which gas and solid and liquid material are caused to pass in counter flow to one and other.

In FIG. 1 there is shown a furnace 1 in which there is maintained a molten bath 2 containing lead oxide. Directed towards the bath is a lance 3, to which a contaminated lead-sulphide concentrate is charged, as indicated by the arrow 4, and an oxygen-containing vehicle gas, as indicated by the arrow 5 for partial oxidation and flame smelting of the concentrate. Issuing from the mouth 6 of the lance 3 is a flame-smelted lead product having a considerable residual sulphide content. When this lead product contacts the melt 7 containing lead oxide, as indicated at 8, lead metal is formed by a roast reaction. The lead will collect in the lower part of the melt 2, as shown at 9. As shown by the arrows 10, gas issuing from the lance 3 will flow towards the gas outlet 11, from where the gas is passed to a gas-purifying arrangement (not shown) for recovering the impurities contained in the gas, before using the gas to recover the sulphur-dioxide content. An oxidic flame-smelting product is charged to a location beneath the surface of the bath 2 in the furnace 1 through a lance 12, as shown by arrow 13. The gas from the lance 12 passes through the lead-oxide bath 7 and up through the furnace space 14, towards the gas outlet 11, as shown by arrows 15. The crude lead formed is removed at 16 and passed to suitable refining apparatus.

In FIG. 2 there is illustrated a shaft 21 in which sulphide concentrates are flame smelted. The lowermost part of the shaft 21 passes directly into a separation zone 22, in which the molten product in the shaft 21 is separated into crude lead and slag, which can be removed separately from this zone.

Arranged in the roof of the shaft 21 is a first ring of nozzles 23 through which finely-divided contaminated sulphide concentrates, finely divided silica and/or other slag formers or fluxing agents, recycled-dust and oxygen-gas or other gas for maintaining the flame-smelting process, such as air or oxygen-enriched air, are charged to the shaft. In the illustrated embodiment, the solid material is supplied to the nozzles 23 through lines 24, 25, and air, optionally enriched with oxygen, is supplied through a line 26 and lines 27 and 28 branching therefrom. The nozzles 23, of which only two are shown in the drawing, are directed obliquely downwardly and tangentially to an imaginary circle having a diameter smaller than the smallest transverse dimensions of the shaft, so as to obtain a vortex-like movement in the shaft. Air is also passed to the shaft 21 through horizontal nozzles 29, fed from lines 27 via lines 30 branching from said lines 27, said lines 30 being directed to a certain extent tangentially, to assist the vortex-like movement produced by the nozzles 23. As indicated at 29*a*, further nozzles for supplying gas to selected levels of the upper zone 35 may be arranged, said nozzles being supplied from the lines 27. Substantially non-contaminated lead-sulphide concentrates are supplied to the shaft through nozzles 31, which are arranged in substantially the same manner as the nozzles 23, the nozzles 31 being supplied from lines 32 and 33. In the illustrated example, the vehicle gas for the concentrates is oxygen gas, which is supplied to the nozzles 31 through lines 34, said lines being supplied from the line 36. To ensure a high oxidation potential in the lower vortex, while at the same time assisting the vortex-like movement, oxygen gas is also supplied through the horizontal nozzles 38, which are supplied via lines 36 and 39.

During the passage from the nozzle 23 down through the zone 35 of the shaft 21, the contaminated concentrate is melted and partially roasted and volatile sulphidic and metallic impurities, such as Hg, As, Sb, Bi and Sn are fumed off. The concentrate is further roasted during its continued passage down towards the zone 37 of the shaft 21.

When the flame-smelted and partially de-sulphured material from zone 35 meets the oxidic reaction product in zone 37, there is formed, by the roast reaction, metallic lead in an amount dependent upon the stoichiometric proportions between the two flame-smelting products in the upper and lower vortex respectively. The final product is collected in the separate zone 22 located beneath the lower vortex, whereat a crude-lead metal phase is collected on the bottom of said zone, as shown at 40, and an oxidic phase optionally bound to silicate as slag, will cover the metallic phase. As indicated at 42, the metal phase may be removed continuously. The oxidic phase or slag phase is removed when necessary, as indicated at 43, for further treatment and for recovering any metal values present therein.

We claim:

1. A method for recovering lead from sulphidic lead raw-material containing impurities from the group consisting of bismuth, arsenic, antimony and tin, by flame-smelting said material with an oxygen-containing gas, said method comprising adjusting the oxygen potential and temperature during the flame smelting process so as to form a product substantially comprising a lead-sulphide melt substantially free from volatile, sulphidic and metallic impurities of said kind; bringing the lead-sulphide melt into contact with an oxidic lead material substantially free from impurities of said kind while oxidising the sulphide-sulphur content of said material and forming a melt substantially free of sulphur; and separating lead from said melt.

2. The method according to claim 1, wherein said oxidic lead material comprises a product obtained by flame smelting a lead-sulphide concentrate substantially free of impurities of said kind, with oxygen.

3. The method according to claim 1 or claim 2, in which flame smelting of said material is effected with the aid of at least one first and at least one second lance, including charging to said first lance a lead-sulphide concentrate which is substantially free from impurities together with an excess of oxygen, said first lance discharging beneath the surface of the molten bath formed by the flame-smelting process; and charging to the second lance the sulphidic, contaminated lead raw material and a vehicle gas containing excess oxygen, said second lance being directed towards and discharging above the surface of the molten bath.

4. The method according to claim 1 or claim 2, wherein said flame-smelting process is carried out in a furnace having two mutually separate flame-smelting shafts.

5. The method according to claim 1 or claim 2, wherein said flame-smelting process is carried out in accordance with a counter flow method in a shaft divided into two zones, comprising charging the sulphidic contaminated lead raw material to an upper zone in the shaft together with a vehicle gas which is relatively poor in oxygen; charging the lead-sulphide concentrate substantially free from impurities to a lower zone located beneath the upper zone in said shaft, together with a vehicle gas having excess oxygen; and bringing the product of the flame-smelting process from the upper zone into contact with the product of said flame-smelting process from the lower zone to form a melt which is substantially free from sulphur and which contains lead and/or lead oxide.

6. The method according to claim 1 or claim 2, wherein said flame-smelting process is carried out in a vortex.

7. The method according to claim 1, including subjecting said melt substantially free of sulphur to a reducing process prior to separating lead from said melt.

* * * * *